US011761293B2

(12) United States Patent
Least et al.

(10) Patent No.: US 11,761,293 B2
(45) Date of Patent: Sep. 19, 2023

(54) SWELLABLE PACKER ASSEMBLIES, DOWNHOLE PACKER SYSTEMS, AND METHODS TO SEAL A WELLBORE

(71) Applicant: Halliburton Energy Services, Inc., Houston, TX (US)

(72) Inventors: Brandon Least, Bartonville, TX (US); Michael L. Fripp, Carrollton, TX (US); Stephen M. Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/121,448

(22) Filed: Dec. 14, 2020

(65) Prior Publication Data

US 2022/0186578 A1 Jun. 16, 2022

(51) Int. Cl.
*E21B 33/127* (2006.01)
*E21B 33/13* (2006.01)

(52) U.S. Cl.
CPC ..... *E21B 33/127* (2013.01); *E21B 33/13* (2013.01)

(58) Field of Classification Search
CPC ..... E21B 33/12; E21B 33/127; E21B 33/13; E21B 23/06; E21B 23/04
See application file for complete search history.

(56) References Cited

U.S. PATENT DOCUMENTS 1,982,569 A 11/1934 Byrd
3,046,601 A 7/1962 Hubbert et al.
3,385,367 A 5/1968 Kollsman
3,993,577 A 11/1976 Black et al.
4,445,694 A 5/1984 Flaherty
4,612,985 A 9/1986 Rubbo et al.
4,846,278 A 7/1989 Robbins
(Continued)

FOREIGN PATENT DOCUMENTS

CA 2751473 A1 8/2010
CA 2751473 C 9/2014
(Continued)

OTHER PUBLICATIONS

International Search Report & Written Opinion in PCT/US2020/065539, dated Aug. 30, 2021.
(Continued)

*Primary Examiner* — Caroline N Butcher
(74) *Attorney, Agent, or Firm* — Barnes & Thornburg, LLP

(57) ABSTRACT

Swellable packer assemblies, downhole packer systems, and methods to seal a wellbore are presented. A swellable packer assembly includes a mandrel and a sealing material disposed about a portion of the mandrel, where the sealing material is formed from a material that radially expands from the mandrel in response to fluid exposure. The swellable packer assembly also includes a cover that is initially disposed about a portion of an outer surface of the sealing material, where the cover prevents the sealing material from being exposed to fluid while the cover is positioned about the portion of the outer surface of the sealing material, and a pressure-actuated piston configured to shift from a first position about the mandrel to a second position about the mandrel, where the sealing material is exposed to fluid after the pressure-actuated piston shifts from the first position towards the second position.

20 Claims, 4 Drawing Sheets

(56) References Cited

U.S. PATENT DOCUMENTS 5,070,942 A 12/1991 McInnes
5,139,235 A 8/1992 Kilmer
5,163,321 A 11/1992 Perales
5,803,177 A 9/1998 Hriscu et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,702,029 B2 7/2017 Fripp et al.
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2003/0159829 A1 8/2003 Fripp et al.
2004/0118572 A1* 6/2004 Whanger ..... E21B 33/12 166/207
2004/0149418 A1 8/2004 Bosma et al.
2004/0244994 A1 12/2004 Jackson et al.
2005/0039927 A1 2/2005 Wetzel et al.
2005/0092485 A1 5/2005 Brezinski et al.
2005/0171248 A1 8/2005 Li et al.
2005/0199401 A1 9/2005 Patel et al.
2005/0257961 A1 11/2005 Snell et al.
2006/0039927 A1 2/2006 Aoki et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 6/2008 Marya et al.
2008/0185150 A1 8/2008 Brown
2008/0185158 A1 8/2008 Chalker et al.
2008/0194717 A1 8/2008 Vaidya et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0163252 A1 7/2010 Regnault De La Mothe et al.
2010/0212891 A1 8/2010 Stewart et al.
2010/0270031 A1 10/2010 Patel
2010/0307770 A1 12/2010 Sponchia et al.
2011/0073310 A1 3/2011 Clemens
2011/0098202 A1 4/2011 James et al.
2011/0174504 A1 7/2011 Wright et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205091 A1 8/2012 Turley et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056207 A1 3/2013 Wood et al.
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0318780 A1* 10/2014 Howard ..... E21B 23/06 166/317
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Drager et al.
2015/0369027 A1 12/2015 Jones et al.
2016/0032696 A1 2/2016 Caccialupi et al.
2016/0097252 A1 4/2016 Resink
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0273299 A1 9/2016 Fripp et al.
2016/0312586 A1 10/2016 De Clute-Melancon
2016/0319633 A1 11/2016 Cooper et al.
2016/0326829 A1 11/2016 Dolog et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0234103 A1 8/2017 Frazier
2017/0261137 A1 9/2017 Williams et al.

(56) References Cited

U.S. PATENT DOCUMENTS

| | | | |
|---|---|---|---|
| 2017/0335673 | A1 | 11/2017 | Burke et al. |
| 2018/0078998 | A1 | 3/2018 | Sherman |
| 2018/0085154 | A1 | 3/2018 | Kuiper et al. |
| 2018/0087346 | A1 | 3/2018 | Rochen |
| 2018/0087350 | A1 | 3/2018 | Sherman |
| 2018/0094492 | A1 | 4/2018 | Knapp et al. |
| 2018/0202271 | A1 | 7/2018 | Semple et al. |
| 2018/0245420 | A1 | 8/2018 | Ringgenberg |
| 2018/0266215 | A1 | 9/2018 | Fagley, IV et al. |
| 2018/0320472 | A1 | 11/2018 | Fripp. et al. |
| 2018/0355691 | A1 | 12/2018 | Andersen |
| 2018/0355693 | A1 | 12/2018 | Al-AbduJabbar et al. |
| 2019/0017285 | A1 | 1/2019 | Kain |
| 2019/0055808 | A1* | 2/2019 | Krueger ..... E21B 33/1208 |
| 2019/0055839 | A1 | 2/2019 | Skillingstad et al. |
| 2019/0128074 | A1* | 5/2019 | Stokes ..... E21B 33/12 |
| 2019/0153852 | A1* | 5/2019 | Lallemand ..... E21B 47/12 |
| 2019/0203101 | A1 | 7/2019 | Dusterhoft et al. |
| 2019/0249509 | A1 | 8/2019 | Jakkula et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0079756 | A1 | 3/2021 | Ornelaz et al. |
| 2021/0140255 | A1 | 5/2021 | Greci et al. |
| 2021/0189817 | A1 | 6/2021 | Fripp et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | |
|---|---|---|---|
| CA | 3085547 | A1 | 8/2019 |
| CN | 1708631 | A | 12/2005 |
| CN | 102027189 | A | 4/2011 |
| CN | 104583530 | A | 4/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| EP | 2399000 | A2 | 12/2011 |
| EP | 2217790 | B1 | 10/2016 |
| EP | 2753791 | B1 | 6/2017 |
| FR | 3073549 | A1 | 5/2019 |
| GB | 2381278 | A | 4/2003 |
| GB | 2416796 | A | 2/2006 |
| GB | 2469723 | A | 10/2010 |
| GB | 2514195 | B | 6/2019 |
| GB | 2583232 | A | 10/2020 |
| GB | 2557397 | B | 8/2021 |
| GB | 2600258 | B | 4/2022 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 0026501 | A1 | 5/2000 |
| WO | 2008079486 | A1 | 7/2008 |
| WO | 2010096417 | A2 | 8/2010 |
| WO | 2012090056 | A2 | 7/2012 |
| WO | 2013033208 | A1 | 3/2013 |
| WO | 2014098885 | A1 | 6/2014 |
| WO | 2014110382 | A1 | 7/2014 |
| WO | 2014210283 | A1 | 12/2014 |
| WO | 2016081287 | A1 | 5/2016 |
| WO | 2016171666 | A1 | 10/2016 |
| WO | 2018005740 | A1 | 1/2018 |
| WO | 2018057361 | A1 | 3/2018 |
| WO | 2018085102 | A1 | 5/2018 |
| WO | 2018102196 | A1 | 6/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2020068037 | A1 | 4/2020 |
| WO | 2021021203 | A1 | 2/2021 |
| WO | 2021076141 | A1 | 4/2021 |

OTHER PUBLICATIONS

International Search Report and Written Opinion dated Aug. 2, 2018, International PCT Application No. PCT/US2017/061307.
Search Report in FR Application No. 1859379, dated Oct. 15, 2019.
International Search Report and Written Opinion dated Nov. 19, 2018; International PCT Application No. PCT/US2018/019337.
Denmark Examination Report and Search Report date dated Mar. 16, 2021, Denmark Application No. PA202070389.
International Search Report and Written Opinion dated Jul. 8, 2020, issued in related International Application No. PCT/US2019/056814.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
Nemisis Annulus Swellable Packer, Weatherford, Swellable Products, 2009-2011.
International Search Report and Written Opinion dated Nov. 22, 2019; International PCT Application No. PCT/US2019/019210.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-413, Petroleum Exploration and Development, vol. 42, Issue 3.
Dutch Search Report issued in NL 2026726, dated Aug. 13, 2021.
International Search Report and Written Opinion in PCT/US2020/066193, dated Sep. 8, 2021.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report date dated Dec. 17, 2021; CN Application No. 2018800875885.
Examination Report in GB Appln No. 2010931.0 dated Jan. 18, 2022.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.
Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.

(56) References Cited

OTHER PUBLICATIONS

International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.
DK Examination Report in Application No. PA 202070389, dated Oct. 20, 2021.
International Preliminary Report on Patentability in PCT/US2019/068493, dated Jun. 30, 2022.
International Preliminary Report on Patentability in PCT/US2019/068497, dated Jun. 30, 2022.
International Preliminary' Reporton Patentability in PCT/US2019/019210, dated Aug. 24, 2021.
International Preliminary Reporton Patentability in PCT/US2019/058904, dated May 3, 2022.
International Preliminary Report on Patentability in PCT/US2019/056814, dated Apr. 19, 2022.
Fripp, Novel Expanding Metal Alloy for Non-Elastomeric Sealing and Anchoring, Research Paper, Oct. 3, 2022, 8 pages, Society of Petroleum Engineers, SPE-210273-MS.
International Search Report and Written Opinion dated Feb. 10, 2021; International Application No. PCT/US2020/034887.
First Examination Report in SA Application No. 522441072 dated May 29, 2023.
Written Opinion & Search Report in SG Application No. 11202112174W, dated Jul. 24, 2023.

* cited by examiner

SWELLABLE PACKER ASSEMBLIES, DOWNHOLE PACKER SYSTEMS, AND METHODS TO SEAL A WELLBORE

BACKGROUND

The present disclosure relates generally to swellable packer assemblies, downhole packer systems, and methods to seal a wellbore.

Wellbores are sometimes drilled from the surface of a wellsite several hundred to several thousand feet downhole to reach hydrocarbon resources. Packers are sometimes run downhole and set at different downhole locations to form one or more isolation zones in a wellbore. Some packers contain materials that radially expand outwards to form an isolation zone in the wellbore.

BRIEF DESCRIPTION OF THE DRAWINGS

Illustrative embodiments of the present disclosure are described in detail below with reference to the attached drawing figures, which are incorporated by reference herein, and wherein.

Figure 1:
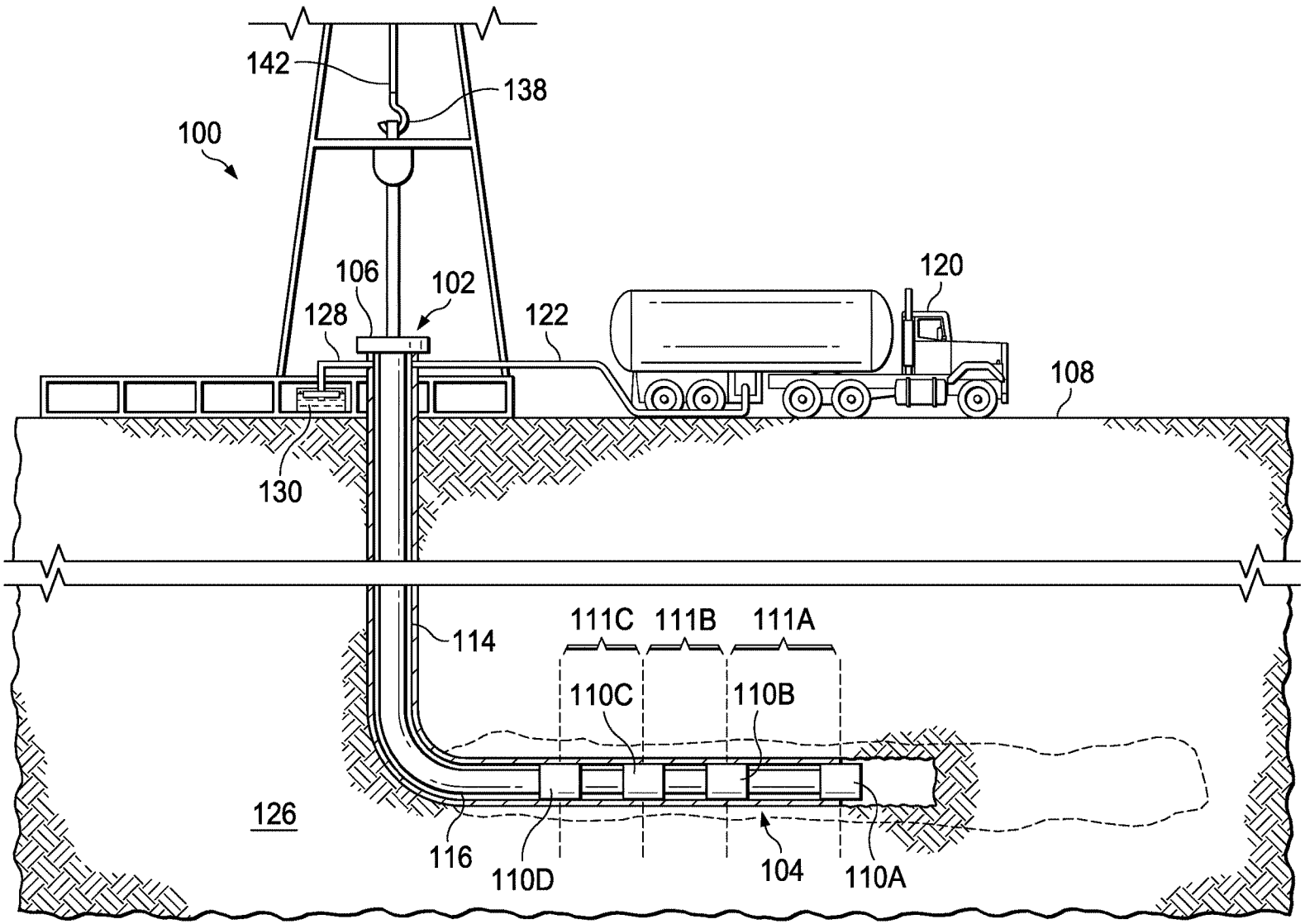
FIG. 1 is a schematic, side view of a well environment in which a downhole packer system having four swellable packer assemblies is deployed in the wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to swellable packer assemblies, downhole packer systems, and methods to seal a wellbore. Swellable packer assemblies described herein are deployable in open-hole and cased-hole wellbores. A swellable packer assembly includes a mandrel having an interior flow passage. In some embodiments, the mandrel is directly or indirectly coupled to a conveyance that is run downhole. As referred to herein, a conveyance may be a work string, drill string, drill pipe, wireline, slickline, coiled tubing, production tubing, downhole tractor or another type of conveyance operable to be deployed in a wellbore. The swellable packer assembly also includes a sealing material that is formed from a material that radially expands from the mandrel in response to exposure to a fluid, such as wellbore fluid. As referred to herein, radial expansion refers to expansion from a point or location inside a wellbore (such as from the exterior surface of the mandrel) in a direction towards the wellbore. The material has properties that increase in mass and volume upon contact with a fluid or "swells." Additional descriptions of the sealing material are provided herein.

The swellable packer assembly also includes a cover that initially prevents the sealing material from being exposed to a fluid. As referred to herein, a cover is any device or component configured to prevent the sealing material from being exposed to a fluid while the cover is in an initial position. In some embodiments, the cover is a sleeve that is configured to prevent sealing material from being exposed to the fluid while in one position, and is configured to allow the sealing material to be exposed to the fluid while in a second position. In some embodiments, the cover is formed from a dissolvable material, a degradable material, a meltable material, or a combination of the foregoing types of materials that partially or completely dissolves, degrades, melts, and/or softens in response to an expansion of the sealing material. In some embodiments, the expansion of the sealing material is an exothermic reaction that degrades, melts, dissolves, corrodes, and/or softens the cover.

The swellable packer assembly also includes a pressure-actuated piston. As referred to herein, a pressure-actuated piston is any piston or piston assembly that is configured to shift or actuate in response to a threshold of amount of pressure (such as 10 psi, 100 psi, 1,000 psi, or another amount of pressure) or force directly or indirectly applied to the piston or a component of the piston assembly. The pressure-actuated piston is shiftable from a first position about the mandrel to a second position about the mandrel to expose the sealing material to the fluid. In some embodiments, the pressure-actuated piston is disposed along an exterior surface of the mandrel. In some embodiments, the pressure-actuated piston is partially or completely disposed inside the mandrel. In some embodiments, the pressure-actuated piston is directly or indirectly coupled to the cover, such that the pressure-actuated piston shifts the cover to expose the sealing element to the fluid. In some embodiments, the pressure-actuated piston shifts towards the cover. In one or more of such embodiments, pressure or force generated by the pressure-actuated piston onto the cover causes the cover to buckle or break, thereby exposing the sealing element to the fluid. In some embodiments, the swellable packer assembly has one or more shear pins that initially engage the pressure-actuated piston to prevent premature movement of the pressure-actuated piston. In one or more of such embodiments, the one or more shear pins shear in response to a threshold amount of force or pressure applied to the shear pins. For example, after the swellable packer assembly is positioned at a desired location of the wellbore, a threshold amount of pressure or force is applied through the mandrel to shear the shear pins and to actuate the pressure-actuated piston.

In some embodiments, the swellable packer assembly includes a port that is disposed about a wall of the mandrel. The port fluidly connects the interior flow passage of the mandrel to the pressure-actuated piston. Moreover, the port allows pressure applied through the interior flow passage of the mandrel to also be applied to the pressure-actuated piston, thereby shifting the pressure-actuated piston. In some embodiments, the pressure-actuated piston shifts in response to a threshold amount of pressure applied through the port. In some embodiments, the port is initially sealed by a material while the swellable packer assembly is run downhole to prevent premature shifting of the pressure-actuated piston. In one or more of such embodiments, the material seals the port until the swellable packer assembly is positioned at a desired location. In one or more of such embodiments, the material is a degradable, corrodible, or dissolvable material that degrades, corrodes, or dissolves after a threshold amount of time to prevent premature shifting of the pressure-actuated piston. Additional descriptions of the material are provided herein.

In a downhole packer system, which includes one or more swellable packer assemblies, the mandrel of each swellable packer assembly is coupled to a conveyance of the downhole packer system. FIG. 1 for example, illustrates a downhole packer system having multiple swellable packer assemblies. In some embodiments, the mandrel of each swellable packer assembly is coupled to subs (such as a top sub and a bottom sub), which in turn are coupled to the conveyance to fit the swellable packer assemblies onto the conveyance. Additional descriptions of swellable packer assemblies, downhole packer systems, and methods to seal a wellbore are provided in the paragraphs below and are illustrated in FIGS. 1-4.

Turning now to the figures, FIG. 1 is a schematic, side view of a well environment 100 in which a downhole packer system 104 having four swellable packer assemblies 110A-110D is deployed in a wellbore 114. As shown in FIG. 1, wellbore 114 extends from surface 108 of well 102 to or through formation 126. A hook 138, a cable 142, traveling block (not shown), and hoist (not shown) are provided to lower conveyance 116 (such as a work string) of downhole packer system 104 and swellable packer assemblies 110A-110D down wellbore 114 of well 102 until swellable packer assemblies 110A-110D are positioned at desired locations. In some embodiments, downhole packer system 104 includes additional subs that are fitted onto conveyance 116, and each swellable packer assembly 110A, 110B, 110C, and 110D is fitted onto a pair of the subs (such as a top sub and a bottom sub pair) to securely fit swellable packer assemblies 110A-110D to conveyance 116. In the embodiment of FIG. 1, swellable packer assemblies 110A-110D are positioned along different sections of conveyance 116. Further, swellable packer assemblies 110A-110D are set by applying a threshold amount of pressure to shift pressure-actuated pistons of the respective swellable packer assemblies 110A-110D to form isolation zone 111A, isolation zone 111B, and isolation zone 111C. Additional descriptions of the components of swellable packer assemblies 110A-110D are provided herein and are illustrated in at least FIG. 2 and FIGS. 3A-3B. In some embodiments, downhole packer system 104 includes additional swellable packer assemblies that are deployable to form additional isolation zones.

In some embodiments, after the swellable packer assemblies 110A-110D are positioned at desirable locations, a pressure differential between pressure at interior regions of swellable packer assemblies 110A-110D and pressure at areas wellbore 114 surrounding swellable packer assemblies 110A-110D displaces pressure-actuated pistons of swellable packer assemblies 110A-110D and sets swellable packer assemblies 110A-110D. In some embodiments, pressure is applied from a downhole location to set swellable packer assemblies 110A-110D. In some embodiments, pressure is applied from surface, such as through an inlet conduit 122 or through another conduit (not shown) to set swellable packer assemblies 110A-110D. In one or more of such embodiments, inlet conduit 122 is coupled to a fluid source 120 to provide fluids into well 102 and formation 126. Moreover, a threshold amount of fluid pressure generated by fluids pumped through inlet conduit 122 and conveyance 116 displaces pressure-actuated pistons of swellable packer assemblies 110A-110D and sets swellable packer assemblies 110A-110D. In some embodiments, fluids pumped from fluid source 120 eventually flow into areas of wellbore 114 surrounding swellable packer assemblies 110A-110D, where the fluids interact with sealing materials of swellable packer assemblies 110A-110D to set swellable packer assemblies 110A-110D. In some embodiments, where swellable packer assemblies 110A-110D have ports (shown in FIGS. 2 and 3A-3B) that are initially partially or completely sealed by materials to prevent swellable packer assemblies 110A-110D from setting prematurely, fluids pumped downhole also degrade, dissolve, corrode, melt, and/or displace the materials to provide fluid and pressure communication through the ports. Further, in some embodiments, where well operations, such as perforating or fracturing operations, are performed after one or more of swellable packer assemblies 110A-110D are set, fluids used for such operations are also pumped from fluid source 120 into conveyance 116 during such operations. In the embodiment of FIG. 1, fluids are circulated into well 102 through conveyance 116 and back toward surface 108. To that end, a diverter or an outlet conduit 128 may be connected to a container 130 at the wellhead 106 to provide a fluid return flow path from wellbore 114.

Although FIG. 1 illustrates a cased wellbore, downhole packer system 104 illustrated in FIG. 1, as well as other downhole packer systems described herein, are deployable in open-hole wellbores, and cased wellbores and open-hole wellbores of offshore wells. Further, although FIG. 1 illustrates downhole packer system 104 having four swellable packer assemblies 110A-110D that form three isolation zones 111A-111C, respectively, in other embodiments, downhole packer system 104 includes a different number of swellable packer assemblies that form a different number of isolation zones. Additional descriptions and illustrations of swellable packer assemblies are provided in the paragraphs below and are illustrated in at least FIGS. 2 and 3A-3B. Further, additional descriptions and illustrations of methods to seal a wellbore are provided in the paragraphs below and are illustrated in at least FIG. 4.

Figure 2:
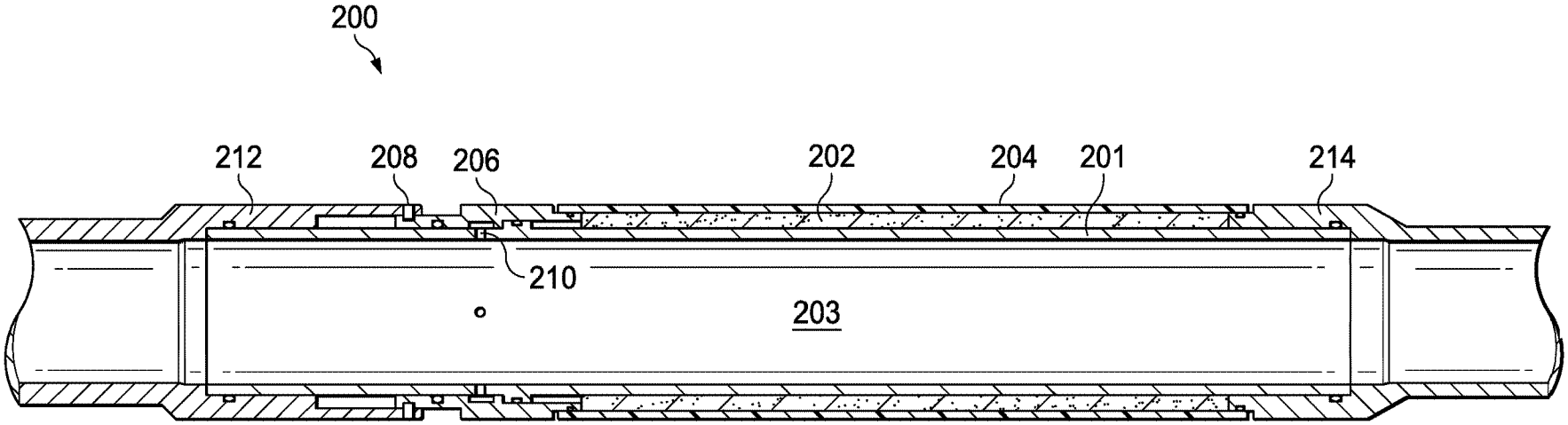
FIG. 2 is a cross-sectional view of a swellable packer assembly similar to the swellable packer assemblies of FIG. 1.

FIG. 2 is a cross-sectional view of a swellable packer assembly 200 similar to swellable packer assemblies 110A-110D of FIG. 1. In the embodiment of FIG. 2, swellable packer assembly 200 has a mandrel 201 and a sealing material 202 that is disposed around an exterior portion of mandrel 201. Sealing material 202 is formed from a material that radially expands from the mandrel in response to exposure to a fluid. In some embodiments, sealing material 202 includes any metal or metal alloy that may undergo a hydration reaction to form a metal hydroxide of greater volume than the base metal or metal alloy reactant. In one or more of such embodiments, the metal becomes separate particles during the hydration reaction and these separate particles lock or bond together to form what is considered as a swellable metal. Examples of suitable metals for sealing material 202 include, but are not limited to, magnesium, calcium, aluminum, tin, zinc, beryllium, barium, manganese, or any combination thereof. Preferred metals include magnesium, calcium, and aluminum. Examples of suitable metal alloys for sealing material 202 include, but are not limited to, any alloys of magnesium, calcium, aluminum, tin, zinc, beryllium, barium, manganese, or any combination thereof, such as, but not limited to, alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some embodiments, sealing material 202 includes an oxide. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof. In some embodiments, sealing material 202 is selected from materials that do not degrade into brine.

Swellable packer assembly 200 also includes a cover 204 that is initially disposed around or about a portion of the outer surface of sealing material 202. Cover 204 prevents sealing material 202 from being exposed to a fluid while cover 204 is intact and is in the initial position illustrated in FIG. 2. In some embodiments, cover 204 is a sleeve that shifts from the initial position illustrated in FIG. 2 to another position to expose sealing material 202 to a fluid. In some embodiments, the cover 204 is formed from a dissolvable material, a degradable material, a meltable material, or a combination of the foregoing types of materials that partially or completely dissolves, degrades, melts, and/or softens in response to an expansion of sealing material 202. Examples of degradable materials include, but are not limited to, magnesium alloy, aluminum alloy, aliphatic polyester, and urethane. Examples of meltable materials include, but are not limited to, bismuth, indium, gallium, tin, lead, and antimony. In some embodiments, the expansion of sealing material 202 is an exothermic reaction that degrades, melts, dissolves, corrodes, and/or softens cover 204. In one or more of such embodiments, cover 204 is selected from a meltable material that has a threshold melting point (e.g., 500°, 600°, or another threshold temperature). In one or more of such embodiments, cover 204 is selected from a meltable material that has a melting point that is within a threshold temperature range of the downhole temperature (e.g., within 50° of the downhole temperature, more than 60° of the downhole temperature, of another threshold temperature range of the downhole temperature).

Swellable packer assembly 200 also includes a pressure-actuated piston 206. Pressure greater than a threshold amount directly or indirectly applied to pressure-actuated piston 206 shifts pressure-actuated piston 206 from the position illustrated in FIG. 2 to another position, such as the position illustrated in FIG. 3B, to expose sealing material 202 to a fluid. In the embodiment of FIG. 2, pressure-actuated piston 206 is initially coupled to cover 204. In one or more of such embodiments, pressure-actuated piston 206 shifts cover 204 as pressure-actuated piston 206 shifts to the position illustrated in FIG. 2 to another position to expose sealing material 202 to a fluid.

In the embodiment of FIG. 2, pressure-actuated piston 206 is initially held in the position illustrated in FIG. 2 by a shear pin 208 that is configured to shear in response to a threshold amount of pressure (e.g., 100 psi, 1,000 psi, or another amount of pressure) or force to prevent sealing material 202 from being exposed to a fluid prematurely, such as while swellable packer assembly 200 is being run downhole. Further, a port 210 is disposed in a wall of mandrel 201 to provide fluid and pressure communication from an interior passage 203 of mandrel 201 to pressure-actuated piston 206. In some embodiments, port 210 is initially sealed by a degradable, corrodible, dissolvable, meltable, and/or displaceable material that initially prevents fluid and pressure communication through port 210 to prevent sealing material 202 from being exposed to a fluid prematurely. In one or more of such embodiments, the material is degraded, corroded, dissolved, melted, and/or displaced after swellable packer assembly 200 is disposed at a desired location.

In the embodiment of FIG. 2, swellable packer assembly 200 is coupled to a top sub 212 and a bottom sub 214, which in turn are coupled to a conveyance, such as conveyance 116 of FIG. 1. In some embodiments, swellable packer assembly 200 is directly coupled to a conveyance. In some embodiments, top sub 212 and bottom sub 214 are components of swellable packer assembly 200.

Although FIG. 2 illustrates sealing material 202 disposed around an exterior portion of mandrel 201, in some embodiments, sealing material 202 is initially partially or completely disposed inside mandrel 201. Further, although FIG. 2 illustrates a single port, in some embodiments, multiple ports (not shown) are disposed in mandrel 201 to provide fluid and pressure communication with pressure-actuated piston 206. Similarly, although FIG. 2 illustrates a single shear pin 208, in some embodiments, pressure-actuated piston 206 is initially held in place by multiple shear pins (not shown).

Figure 3A:
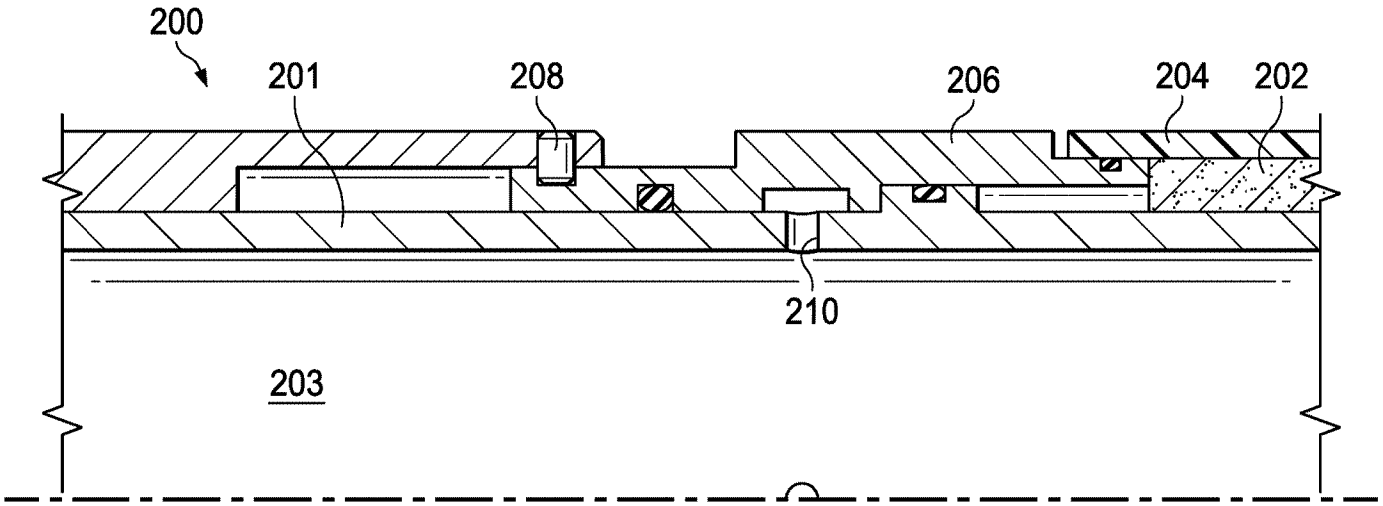
FIG. 3A is a zoomed-in view of the swellable packer assembly of FIG. 2 before the pressure-actuated piston of the swellable packer assembly is actuated.

FIG. 3A is a zoomed-in view of swellable packer assembly 200 of FIG. 2 before pressure-actuated piston 206 of swellable packer assembly 200 is actuated. In the embodiment of FIG. 3A, sealing material 202 is disposed between an exterior surface of mandrel 201 and an interior surface of cover 204 such that cover 204 prevents sealing material 202 from being exposed to a fluid. Cover 204 is coupled to pressure-actuated piston 206, which is held in place by shear pin 208. Further, port 210 is disposed about a wall of mandrel 201 and provides fluid and pressure communication between interior flow passage 203 of mandrel 201 and pressure-actuated piston 206. In some embodiments, port 210 is initially partially or completely sealed by a material to prevent pressure-actuated piston 206 from prematurely shifting, such as while swellable packer assembly 200 is being deployed downhole, and during well operations that are performed before swellable packer assembly 200 is set.

After pressure-actuated piston 206 is disposed at a desired location, such as at a boundary of a zone of a wellbore, and swellable packer assembly is ready to be set, internal pressure is applied to actuate pressure-actuated piston 206. In the embodiment of FIG. 3A, internal pressure is applied through port 210. More particularly, an amount of pressure that is greater than or equal to the threshold amount of pressure to shear shear pin 208 is applied from interior passage 203, through port 210, and directly or indirectly onto pressure-actuated piston 206, which in turn shears shear pin 208 and shifts pressure-actuated piston 206 to expose sealing material 202 to a fluid. In some embodiments, where port 210 is initially partially or completely sealed by a material to prevent pressure-actuated piston 206 from prematurely shifting, the material is degraded, dissolved, melted, corroded, and/or displaced to unseal port 210. For example, fluid is pumped by fluid source 120 of FIG. 1 through conveyance 116 of FIG. 1 and interior passage 203, and into port 210, where the fluid interacts with the material to degrade, dissolve, melt, corrode, and/or displace the material.

Figure 3B:
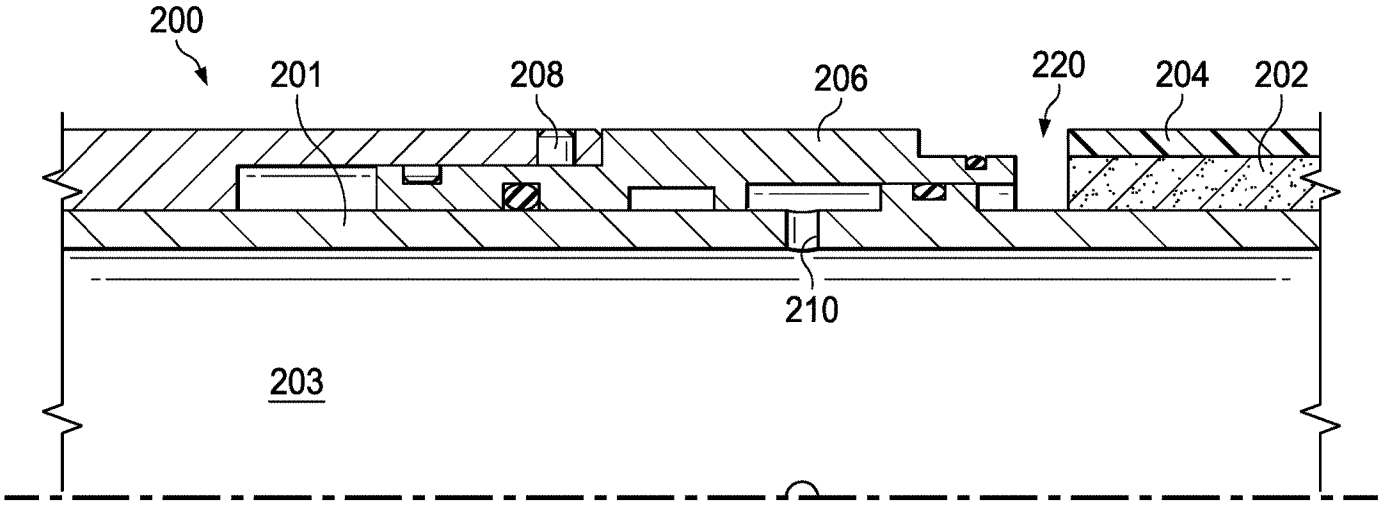
FIG. 3B is a cross-sectional view of the swellable packer assembly of FIG. 2 after the pressure-actuated piston of the swellable packer assembly is actuated.

FIG. 3B is a cross-sectional view of swellable packer assembly 200 of FIG. 2 after pressure-actuated piston 206 of swellable packer assembly 200 is actuated. In the embodiment of FIG. 3B, pressure applied to pressure-actuated piston 206 has sheared shear pin 208 and shifted pressure-actuated piston 206 from the position illustrated in FIG. 3A, in a direction towards shear pin 208, to the position illustrated in FIG. 3B. Further, shifting of pressure-actuated piston 206 also directly or indirectly shifts cover 204 from the position illustrated in FIG. 3A, in a second direction away from shear pin 208, to the position illustrated in FIG. 3B. The shifting of pressure-actuated piston 206 and cover 204 creates an opening 220 that allows a fluid in a section of wellbore near swellable packer assembly 200 to flow through before coming into contact with sealing material 202. In some embodiments, the expansion of sealing material 202 degrades, dissolves, corrodes, melts, and/or displaces cover 204, thereby allowing sealing material 202 to radially expand outwards to a wall of a wellbore to seal the wellbore. In one or more of such embodiments, the expansion of sealing material 202 also heats up cover 204, thereby partially or completely melting cover 204. In one or more of such embodiments, the expansion of sealing material 202 applies a force onto cover 204, thereby partially or completely displacing cover 204. In one or more of such embodiments, the expansion of sealing material 202 is due to a reaction that also corrodes, dissolves, melts, degrades, and/or displaces cover 204.

Although FIG. 3B illustrates pressure-actuated piston 206 and cover 204 shifting in different directions, in some embodiments, pressure-actuated piston 206 and cover 204 shift in the same direction (such as in the direction towards shear pin 208). In one or more of such embodiments, one or more openings (not shown), are formed in a region that was previously covered by cover 204. In some embodiments, pressure-actuated piston 206 shifts onto cover 204, and the force and/or pressure applied by pressure-actuated piston 206 breaks cover 204, causes cover 204 to buckle, and/or displaces cover 204, thereby exposing sealing material 202 to a fluid. In some embodiments, cover 204 is a chemically-resistant barrier or includes a chemically-resistant barrier, where shifting of pressure-actuated piston 206 removes and/or displaces the chemically-resistant barrier. Examples of a chemically-resistant barrier include, but are not limited to, a plastic coasting, a rubber coating, a metal coating, a glass coating, and a ceramic coating. In some embodiments, a chemically-resistant barrier is initially coated on sealing material 202. In one or more of such embodiments, shifting of pressure-actuated piston 206 also removes and/or displaces the chemically-resistant barrier.

Figure 4:
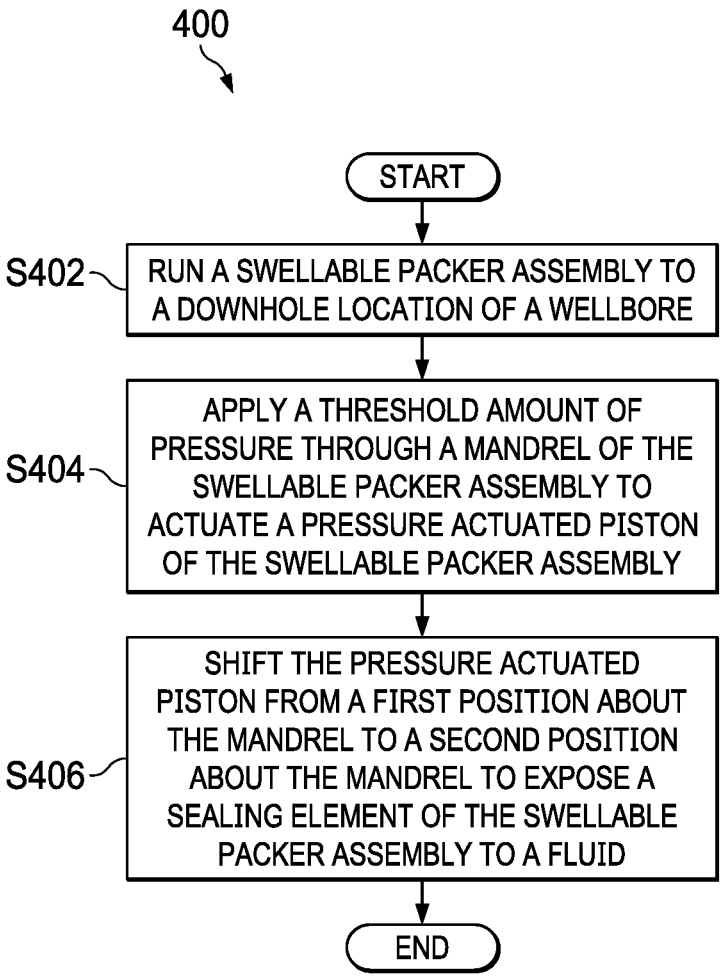
FIG. 4 is a flow chart illustrating a process to seal a wellbore.

FIG. 4 is a flow chart illustrating a process 400 to seal a wellbore. Although the operations in process 400 are shown in a particular sequence, certain operations may be performed in different sequences or at the same time where feasible.

At block 5402, a swellable packer assembly is run downhole to a downhole location of a wellbore. FIG. 1, for example, illustrates a downhole packer system 104 having four swellable packer assemblies 110A-110D run downhole, where each swellable packer assembly 110A, 110B, 110C, and 110D is positioned near a boundary of one or more isolation zones 111A-111C.

At block 5404, a threshold amount of pressure is applied through a mandrel of the swellable packer assembly to actuate a pressure-actuated piston of the swellable packer assembly. In some embodiments, pressure differential between an interior region of the swellable packer assembly, such as inside interior passage 203 of mandrel 201 of FIG. 2, and an area of a wellbore outside of swellable packer assembly 200 of FIG. 2, shifts pressure-actuated piston 206 from the position illustrated in FIG. 2 to another position, such as the position illustrated in FIG. 3B. In some embodiments, pressure is applied from the surface, such as from surface 108 of FIG. 1, through conveyance 116 of FIG. 1, interior passage 203 and port 210 of FIG. 2, to shift pressure-actuated piston 206. In some embodiments, pressure is applied from a downhole location through conveyance 116 of FIG. 1, interior passage 203 of FIG. 2, and port 210 of FIG. 2, to shift pressure-actuated piston 206. In some embodiments, where a port such as port 210 is initially sealed by a material to prevent premature shifting of pressure-actuated piston 206, the material is dissolved, degraded, corroded, melted, or displaced to unseal port 210. In one or more of such embodiments, a fluid that dissolves, degrades, corrodes, or melts the material is pumped into port 210 to unseal port 210. In one or more of such embodiments, a threshold amount of pressure applied by a fluid flowing into port 210 displaces the material, thereby unsealing port 210. In some embodiments, where the pressure-actuated piston is initially held in position by a shear pin to prevent premature shifting of the pressure-actuated piston, an amount of pressure that is greater than or equal to the threshold amount of pressure to shear the shear pin is applied to the pressure-actuated piston to shear the shear pin and to shift the pressure-actuated piston.

At block 5406, the pressure-actuated piston is shifted from a first position about the mandrel to a second position about the mandrel to expose a sealing material of the swellable packer assembly to a fluid. FIGS. 3A-3B for example, illustrate shifting pressure-actuated piston 206 from the position illustrated in FIG. 3A, in a direction towards shear pin 208, to the position illustrated in FIG. 3B to create opening 220, which exposes sealing material 202 to a fluid in the wellbore. In some embodiments, shifting the pressure-actuated piston also shifts the cover, thereby further exposing the sealing material to the fluid. FIGS. 3A-3B for example, illustrate cover 204 being shifted from the first position illustrated in FIG. 3A, in a second direction away from shear pin 208, to the second position illustrated in FIG. 3B to create opening 220, which exposes sealing material 202 to a fluid in the wellbore. In some embodiments, the pressure-actuated piston and the cover are coupled, and shifting of the pressure-actuated piston shifts both the pressure-actuated piston and the cover in the same direction. In some embodiments, fluid exposure causes the sealing material to dissolve, corrode, degrade, melt, and/or displace the cover. The sealing material continues to radially expand outwards until the sealing material reaches the walls of the wellbore and isolates a region of the wellbore. In some embodiments, multiple swellable packer assemblies are disposed at different downhole locations to form one or more isolation zones, such as isolation zones 111A-111C of FIG. 1. In one or more of such embodiments, the foregoing operations described in blocks 5404 and 5406 are performed to set one swellable packer assembly at a time and to isolate one zone at a time. In one or more of such embodiments, the foregoing operations described in blocks 5404 and 5406 are performed to set multiple swellable packer assemblies located at different zones at the same time.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a swellable packer assembly, comprising: a mandrel; a sealing material disposed about a portion of the mandrel, the sealing material formed from a material that radially expands from the mandrel in response to exposure to a fluid; a cover that is initially disposed about a portion of an outer surface of the sealing material, wherein the cover prevents the sealing material from being exposed to the fluid while the cover is positioned about the portion of the outer surface of the sealing material; and a pressure-actuated piston configured to shift from a first position about the mandrel to a second position about the mandrel, wherein the sealing material is exposed to the fluid after the pressure-actuated piston shifts from the first position towards the second position.

Clause 2, the swellable packer assembly of clause 1, further comprising a port disposed about a wall of the mandrel that fluidly connects an interior flow passage of the mandrel to the pressure-actuated piston, wherein the pressure-actuated piston is configured to shift from the first position about the mandrel to the second position about the mandrel in response to a threshold amount of pressure applied through the port.

Clause 3, the swellable packer assembly of clause 2, wherein the port is initially sealed by a degradable material.

Clause 4, the swellable packer assembly of any of clauses 1-3, further comprising a shear pin that initially prevents movement of the pressure-actuated piston.

Clause 5, the swellable packer assembly of clause 4, wherein the shear pin shears in response to a threshold amount of pressure applied through an interior flow passage of the mandrel to the pressure-actuated piston.

Clause 6, the swellable packer assembly of any of clauses 1-5, wherein the pressure-actuated piston is coupled to the cover, and wherein the pressure-actuated piston shifts the cover to expose the sealing material to the fluid.

Clause 7, the swellable packer assembly of any of clauses 1-6, wherein the cover is at least partially formed from a dissolvable material.

Clause 8, the swellable packer assembly of clause 7, wherein the dissolvable material is at least one of a magnesium alloy, an aluminum alloy, an aliphatic polyester, and a urethane.

Clause 9, the swellable packer assembly of any of clauses 1-8, wherein the cover is at least partially formed from a meltable material.

Clause 10, the swellable packer assembly of clause 9, wherein the meltable material is at least one of bismuth, indium, gallium, tin, lead, and antimony.

Clause 11, the swellable packer assembly of any of clauses 1-10, wherein the cover at least partially dissolves, degrades, melts, or softens in response to expansion of the sealing material.

Clause 12, a downhole packer system, comprising: a conveyance; a mandrel coupled to the conveyance; a sealing material disposed about a portion of the mandrel, the sealing material formed from a material that radially expands from the mandrel in response to exposure to a fluid; a cover that is initially disposed about a portion of an outer surface of the sealing material, wherein the cover prevents the sealing material from being exposed to the fluid while the cover is positioned about the portion of the outer surface of the sealing material; and a pressure-actuated piston configured to shift from a first position about the mandrel to a second position about the mandrel, wherein the sealing material is exposed to the fluid after the pressure-actuated piston shifts from the first position towards the second position.

Clause 13, the downhole packer system of clause 12, further comprising a port disposed about a wall of the mandrel that fluidly connects an interior flow passage of the mandrel to the pressure-actuated piston, wherein the pressure-actuated piston is configured to shift from the first position about the mandrel to the second position about the mandrel in response to a threshold amount of pressure applied through the port.

Clause 14, the downhole packer system of clause 13, wherein the port is initially sealed by a degradable material.

Clause 15, the downhole packer system of any of clauses 12-14, further comprising a shear pin that initially prevents movement of the pressure-actuated piston, wherein the shear pin shears in response to a threshold amount of pressure applied through an interior flow passage of the mandrel to the pressure-actuated piston.

Clause 16, a method to seal a wellbore, the method comprising: running a swellable packer assembly to a downhole location of a wellbore; applying a threshold amount of pressure through a mandrel of the swellable packer assembly to actuate a pressure-actuated piston of the swellable packer assembly; and shifting the pressure-actuated piston from a first position about the mandrel to a second position about the mandrel to expose a sealing material of the swellable packer assembly to a fluid, wherein the sealing material radially expands from the mandrel towards the wellbore in response to exposure to the fluid.

Clause 17, the method of clause 16, further comprising: running a second swellable packer assembly to a second downhole location of the wellbore; applying a second threshold amount of pressure through a second mandrel of the second swellable packer assembly to actuate a second pressure-actuated piston of the second swellable packer assembly; and shifting the second pressure-actuated piston from a first position about the second mandrel to a second position about the second mandrel to expose a second sealing material of the second swellable packer assembly to the fluid, wherein the second sealing material radially expands from the mandrel towards the wellbore in response to exposure to the fluid.

Clause 18, the method of clauses 16 or 17, wherein applying the threshold amount of pressure comprises applying the threshold amount of pressure through an interior passageway of the mandrel and a port disposed about a wall of the mandrel to actuate pressure-actuated piston.

Clause 19, the method of any of clauses 16-18, further comprising shifting a cover of the swellable packer assembly from a first position to a second position, wherein the cover prevents the sealing material from being exposed to the fluid while the cover is disposed in the first position, and wherein the sealing material is exposed to the fluid while the cover is disposed in the second position.

Clause 20 the method of any of clauses 16-19, further comprising partially dissolving or partially melting at least a portion of a cover of the swellable packer assembly that initially prevents the sealing material from being exposed to the fluid.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A swellable packer assembly, comprising:

a mandrel;

a sealing material disposed about a portion of the mandrel, the sealing material formed from a material that radially expands from the mandrel in response to exposure to a fluid; wherein a hydration reaction of the sealing material with the fluid induces the radial expansion;

a cover that is initially disposed about a portion of an outer surface of the sealing material, wherein the cover prevents the sealing material from being exposed to the fluid while the cover is positioned about the portion of the outer surface of the sealing material; and a pressure-actuated piston configured to shift from a first position about the mandrel to a second position about the mandrel, wherein the sealing material is exposed to the fluid after the pressure-actuated piston shifts from the first position towards the second position, wherein the cover at least partially dissolves, degrades, or melts in response to the radial expansion of the sealing material from the reaction with the fluid.

2. The swellable packer assembly of claim 1, further comprising a port disposed about a wall of the mandrel that fluidly connects an interior flow passage of the mandrel to the pressure-actuated piston, wherein the pressure-actuated piston is configured to shift from the first position about the mandrel to the second position about the mandrel in response to a threshold amount of pressure applied through the port.

3. The swellable packer assembly of claim 2, wherein the port is initially sealed by a degradable material.

4. The swellable packer assembly of claim 1, further comprising a shear pin that initially prevents movement of the pressure-actuated piston.

5. The swellable packer assembly of claim 4, wherein the shear pin shears in response to a threshold amount of pressure applied through an interior flow passage of the mandrel to the pressure-actuated piston.

6. The swellable packer assembly of claim 1, wherein the pressure-actuated piston is coupled to the cover, and wherein the pressure-actuated piston shifts the cover to expose the sealing material to the fluid.

7. The swellable packer assembly of claim 1, wherein the cover is at least partially formed from a dissolvable material.

8. The swellable packer assembly of claim 7, wherein the dissolvable material is at least one of a magnesium alloy, an aluminum alloy, an aliphatic polyester, and a urethane.

9. The swellable packer assembly of claim 1, wherein the cover is at least partially formed from a meltable material.

10. The swellable packer assembly of claim 9, wherein the meltable material is at least one of bismuth, indium, gallium, tin, lead, and antimony.

11. The swellable packer assembly of claim 1, wherein the cover at least partially dissolves, degrades, melts, or softens in response to expansion of the sealing material.

12. A downhole packer system, comprising:

a conveyance;

a mandrel coupled to the conveyance;

a sealing material disposed about a portion of the mandrel, the sealing material formed from a material that radially expands from the mandrel in response to exposure to a fluid; wherein a hydration reaction of the sealing material with the fluid induces the radial expansion; and a cover that is initially disposed about a portion of an outer surface of the sealing material, wherein the cover prevents the sealing material from being exposed to the fluid while the cover is positioned about the portion of the outer surface of the sealing material, wherein the cover at least partially dissolves, degrades, or melts in response to the radial expansion of the sealing material from the reaction with the fluid.

13. The downhole packer system of claim 12, further comprising a port disposed about a wall of the mandrel that fluidly connects an interior flow passage of the mandrel to the pressure-actuated piston, wherein the pressure-actuated piston is configured to shift from the first position about the mandrel to the second position about the mandrel in response to a threshold amount of pressure applied through the port.

14. The downhole packer system of claim 13, wherein the port is initially sealed by a degradable material.

15. The downhole packer system of claim 12, further comprising a shear pin that initially prevents movement of the pressure-actuated piston, wherein the shear pin shears in response to a threshold amount of pressure applied through an interior flow passage of the mandrel to the pressure-actuated piston.

16. A method to seal a wellbore, the method comprising:

running a swellable packer assembly to a downhole location of a wellbore;

applying a threshold amount of pressure through a mandrel of the swellable packer assembly to actuate a pressure-actuated piston of the swellable packer assembly;

shifting the pressure-actuated piston from a first position about the mandrel to a second position about the mandrel to expose a sealing material of the swellable packer assembly to a fluid, wherein the sealing material radially expands from the mandrel towards the wellbore in response to exposure to the fluid; wherein a hydration reaction of the sealing material with the fluid induces the radial expansion; and at least partially dissolving, degrading, or melting a cover that initially prevents the sealing material from being exposed to the fluid; wherein the cover at least partially dissolves, degrades, or melts in response to the radial expansion of the sealing material from the reaction with the fluid.

17. The method of claim 16, further comprising:

running a second swellable packer assembly to a second downhole location of the wellbore;

applying a second threshold amount of pressure through a second mandrel of the second swellable packer assembly to actuate a second pressure-actuated piston of the second swellable packer assembly; and shifting the second pressure-actuated piston from a first position about the second mandrel to a second position about the second mandrel to expose a second sealing material of the second swellable packer assembly to the fluid, wherein the second sealing material radially expands from the mandrel towards the wellbore in response to exposure to the fluid.

18. The method of claim 16, wherein applying the threshold amount of pressure comprises applying the threshold amount of pressure through an interior passageway of the mandrel and a port disposed about a wall of the mandrel to actuate pressure-actuated piston.

19. The method of claim 16, further comprising shifting a cover of the swellable packer assembly from a first position to a second position, wherein the cover prevents the sealing material from being exposed to the fluid while the cover is disposed in the first position, and wherein the sealing material is exposed to the fluid while the cover is disposed in the second position.

20. The method of claim 16, further comprising partially dissolving or partially melting at least a portion of a cover of the swellable packer assembly that initially prevents the sealing material from being exposed to the fluid.

* * * * *